US007896454B2

(12) United States Patent
Eguchi et al.

(10) Patent No.: US 7,896,454 B2
(45) Date of Patent: Mar. 1, 2011

(54) REMAINING-LIQUID-AMOUNT DISPLAY APPARATUS AND REMAINING-LIQUID-AMOUNT DISPLAY METHOD

(75) Inventors: Takeo Eguchi, Kanagawa (JP); Takumi Namekawa, Kanagawa (JP); Kazuyasu Takenaka, Kanagawa (JP); Shinichi Horii, Kanagawa (JP)

(73) Assignee: Sony Corporation, Tokyo (JP)

( * ) Notice: Subject to any disclaimer, the term of this patent is extended or adjusted under 35 U.S.C. 154(b) by 1073 days.

(21) Appl. No.: 11/430,714

(22) Filed: May 9, 2006

(65) Prior Publication Data

US 2006/0203017 A1 Sep. 14, 2006

Related U.S. Application Data

(63) Continuation of application No. 10/403,367, filed on Mar. 31, 2003, now Pat. No. 7,059,696.

(30) Foreign Application Priority Data

Apr. 2, 2002 (JP) ..... 2002-099655

(51) Int. Cl.
*B41J 2/195* (2006.01)
*B41J 29/393* (2006.01)
*B41J 2/17* (2006.01)

(52) U.S. Cl. ..... 347/7; 347/19; 347/84

(58) Field of Classification Search ..... 347/7, 14, 347/19, 84, 85, 86, 87, 5, 6; 73/304, 304 R, 73/304 C; 340/620
See application file for complete search history.

(56) References Cited

U.S. PATENT DOCUMENTS

| | | | | |
|---|---|---|---|---|
| 3,552,209 | A * | 1/1971 | Johnston | 73/304 R |
| 3,935,739 | A * | 2/1976 | Ells | 73/304 C |
| 4,196,625 | A | 4/1980 | Kerns | |
| 4,203,325 | A * | 5/1980 | Cowles et al. | 73/304 R |
| 4,382,382 | A | 5/1983 | Wang | |
| 4,626,874 | A | 12/1986 | Ameyama | |
| 4,646,569 | A * | 3/1987 | Cosser | 73/304 R |
| 5,033,300 | A | 7/1991 | Matsuo et al. | |
| 5,079,570 | A | 1/1992 | Mohr et al. | |
| 5,097,248 | A | 3/1992 | Kumada et al. | |
| 5,148,708 | A * | 9/1992 | Murata et al. | 73/304 R |
| 5,211,806 | A | 5/1993 | Rangappan | |

(Continued)

FOREIGN PATENT DOCUMENTS

DE 40 17 314 6/1991

(Continued)

*Primary Examiner* — Stephen D Meier
*Assistant Examiner* — Leonard S Liang
(74) *Attorney, Agent, or Firm* — Robert J. Depke; Rockey, Depke & Lyons, LLC

(57) ABSTRACT

A remaining-liquid-amount apparatus for displaying an amount of conductive liquid (ink) remaining in a container includes electrode units which are arranged along a direction in which the liquid level falls when the amount of liquid in the container decreases and which conduct current when the electrode units are in contact with the liquid, a voltage source (pulse generator) which applies a voltage to the electrode units, a liquid detector (DFFs) which detects the presence/absence of the liquid at positions of the electrode units on the basis of whether or not the electrode units conduct current when the voltage is applied by the voltage source, and a remaining-liquid-amount display unit (LEDs) which displays, in steps, the amount of liquid remaining in the container on the basis of the detection result of the presence/absence of the liquid at positions of the electrode units obtained by the liquid detector.

9 Claims, 5 Drawing Sheets

U.S. PATENT DOCUMENTS

| | | | | |
|---|---|---|---|---|
| 5,289,211 | A | | 2/1994 | Morandotti et al. |
| 5,408,223 | A | | 4/1995 | Guillemot |
| 5,552,809 | A | * | 9/1996 | Hosono et al. ..... 347/10 |
| 5,583,544 | A | | 12/1996 | Stamer et al. |
| 5,747,689 | A | | 5/1998 | Hampo et al. |
| 6,007,173 | A | | 12/1999 | DeLouise et al. |
| 6,155,664 | A | | 12/2000 | Cook |
| 6,223,131 | B1 | | 4/2001 | Kanaya et al. |
| 6,641,240 | B2 | | 11/2003 | Hsu et al. |
| 6,776,471 | B2 | | 8/2004 | Nojima |
| 2003/0000303 | A1 | | 1/2003 | Livingston et al. |
| 2003/0025741 | A1 | | 2/2003 | Maeda |

FOREIGN PATENT DOCUMENTS

| | | | | |
|---|---|---|---|---|
| EP | 1999 063 | | | 5/2000 |
| EP | 1 055 520 | | | 11/2000 |
| EP | 1057 644 | | | 12/2000 |
| JP | 58186017 | A | * | 10/1983 |
| JP | 63173648 | A | * | 7/1988 |
| JP | 04-158224 | | | 1/1992 |
| JP | 04158224 | | | 6/1992 |
| JP | 05-201019 | | | 8/1993 |
| JP | 06-226990 | | | 8/1994 |
| JP | 09-224851 | | | 2/1997 |
| JP | 09-169118 | | | 6/1997 |
| JP | 10-006519 | | | 1/1998 |
| JP | 10-073469 | | | 3/1998 |
| JP | HEI 10-073469 | | | 3/1998 |
| JP | 10-250081 | | | 9/1998 |
| JP | 11-023347 | | | 1/1999 |
| JP | HEI 11-023347 | | | 1/1999 |
| JP | 2000-43287 | | | 2/2000 |
| JP | 2000097751 | A | * | 4/2000 |
| JP | 2002-002880 | | | 1/2002 |

* cited by examiner

REMAINING-LIQUID-AMOUNT DISPLAY APPARATUS AND REMAINING-LIQUID-AMOUNT DISPLAY METHOD

The subject matter of application Ser. No. 10/403,367 is incorporated herein by reference. The present application is a continuation of U.S. Ser. No. 10/403,367, filed Mar. 31, 2003 now U.S. Pat. No. 7,059,696, which claims priority to Japanese Patent Application No. JP 2002-099655 filed Apr. 2, 2002, both of which applications are incorporated herein by reference.

BACKGROUND OF THE INVENTION

1. Field of the Invention

The present invention relates to a remaining-liquid-amount display apparatus and a remaining-liquid-amount display method for displaying the amount of conductive liquid remaining in a liquid container. The present invention is applied to, for example, a case where the amount of ink remaining in an inkjet printer is detected and displayed.

2. Description of the Related Art

In inkjet printers, ink contained in an ink tank is supplied to an ink-discharge unit through an ink flow path, and ink droplets are discharged from the ink-discharge unit.

In addition, in inkjet printers, it is necessary to detect the presence/absence of the ink with relatively high accuracy. The reasons for this will be described below. Firstly, it is difficult to determine the amount of remaining ink by observing the ink tank from the outside.

Secondary, if an ink-discharge operation is continued until the ink is completely consumed, there is a risk that the ink-discharge unit will be damaged. As an example of an ink-discharging method used in inkjet printers, a thermal method in which ink contained in ink cells is quickly heated by exothermic elements to discharge ink droplets is known in the art. In this method, there is a risk that the exothermic elements will be damaged if they are heated when there is no ink in the ink cells. Accordingly, the ink-discharge operation (print operation) must be stopped when the amount of remaining ink is reduced to a predetermined level.

Thirdly, in the case of printing on a large sheet of paper, there is a risk that the ink will run out in the middle of the print operation if the amount of remaining ink cannot be detected with high accuracy, and a partially-printed paper sheet will be wasted in such a case.

Accordingly, in view of safety and economic efficiency, it is necessary to detect the amount of remaining ink with high accuracy.

FIG. 2 is an exploded perspective view showing a first example of a known remaining-ink-amount detector (Japanese Unexamined Patent Application Publication No. 5-201019).

In this example, an ink cartridge a includes elastic ink bags b, and the ink bags b are pushed by compression springs c. In addition, strips d move as the amount of ink decreases, so that the amount of remaining ink can be determined by observing the displacement of the strips d through a window e. Accordingly, the amount of remaining ink can be easily detected at low cost.

FIG. 3 is a block diagram showing a second example of a known ink-remaining-amount detector (Japanese Unexamined Patent Application Publication No. 9-169118).

In this example, the amount of remaining ink is calculated on the basis of an initial amount of ink contained in a tank and the number of times an ink droplet has been discharged. An ink-discharge-amount calculator f includes a counter which counts the number of times an ink-discharge operation has been performed and a multiplier which multiplies the count by the amount of ink discharged in a single ink-discharge operation (average volume). Then, the thus obtained value is transmitted to an ink-remaining-amount calculator g as the amount of ink consumed. The ink-remaining-amount calculator g calculates the amount of remaining ink by subtracting the value calculated by the ink-discharge-amount calculator f from the initial amount of ink contained in the tank.

FIG. 4 is a sectional side view showing a third example of a known ink-remaining-amount detector (Japanese Unexamined Patent Application Publication No. 6-226990).

In this example, a pair of electrodes i are disposed at a position close to the bottom surface of an ink cell h, and the presence/absence of ink is detected on the basis of the resistance between the electrodes i.

FIG. 5 is a sectional side view showing a fourth example of a known ink-remaining-amount detector (Japanese Unexamined Patent Application Publication No. 2000-43287).

In this example, an optical sensor is provided which includes light-reflecting members k1 and k2 disposed on the bottom surface of an ink tank j, light-emitting members m1 and m2 which emit light toward the light-reflecting members k1 and k2, respectively, and light-receiving members n1 and n2 which receive the light emitted from the light-emitting members m1 and m2 and reflected by the light-reflecting members k1 and k2, respectively, and the presence/absence of ink is detected on the basis of the manner in which light is received by the light-receiving members n1 and n2 of the optical sensor.

However, the above-described known techniques have the following problems.

That is, the first example in which the amount of remaining ink is determined by visual observation does not comply with the requirements of recent, high-quality inkjet printers. In addition, when the amount of remaining ink is to be shown on a display or the like, mechanical displacements must be converted into electrical signals, which means that a complex structure is required and high costs are incurred.

In addition, in the second example, the amount of ink consumed is calculated by multiplying the average volume of an ink droplet which is discharged in a single ink-discharge operation by the number of times the ink-discharge operation has been performed. However, if, for example, the ink tank has a large capacity, the difference between the actual volume of an ink droplet discharged and the average volume of an ink droplet which is set in advance gradually increases. Therefore, in view of safety, it is necessary to display a message indicating that the ink has run out while a relatively large amount of ink may still remain. Accordingly, the message indicating that the ink has run out must be displayed while an amount of ink sufficient to continue printing is still contained, and the therefore, remaining ink is wasted.

In addition, in the third example, since only the presence/absence of the ink is detected, the amount of remaining ink cannot be determined. Therefore, there may be a case in which the message indicating that the ink has run out is suddenly displayed and the print operation stops. In such a case, the printer cannot be used afterwards unless a spare ink cartridge is available.

The fourth example also has a problem similar to that of the third example. In addition, in the fourth example, the above-described optical sensor for detecting the amount of remaining ink and the method in which the number of times an ink droplet has been discharged is counted are used in combination, so that the accuracy is improved compared to the second example and the problem of the third example, that is, the message indicating that the ink has been run out is suddenly displayed, can be avoided. However, since it is necessary to use the above-described two methods in combination for detecting the amount of remaining ink, the system becomes complex and high costs are incurred.

SUMMARY OF THE INVENTION

Accordingly, an object of the present invention is to provide an apparatus and a method for accurately detecting and displaying, in steps, an amount of liquid, such as ink, remaining in a container thereof with a simple structure.

In order to attain the above-described object, according to one aspect of the present invention, a remaining-liquid-amount display apparatus for displaying an amount of conductive liquid remaining in a liquid container includes a plurality of electrode units which are arranged along a direction in which the liquid level falls when the amount of liquid in the container decreases and which conduct current when the electrode units are in contact with the liquid; a voltage source which applies a voltage to the electrode units; a liquid detector which detects the presence/absence of the liquid at positions of the electrode units on the basis of whether or not the electrode units conduct current when the voltage is applied by the voltage source; and a remaining-liquid-amount display unit which displays, in steps, the amount of liquid remaining in the container on the basis of the detection result of the presence/absence of the liquid at positions of the electrode units obtained by the liquid detector.

Operation

According to the present invention, the electrode units are arranged along a direction in which the liquid level falls when the amount of liquid in the container decreases. Therefore, the electrode units which are above the liquid level are not in contact with the liquid, and the electrode units which are below the liquid level are in contact with the liquid.

Since the liquid is conductive, when the voltage is applied, the electrode units which are in contact with the liquid conduct current, while the electrode units which are not in contact with the liquid does not conduct current.

Accordingly, the position of the liquid level relative to the positions of the electrode units can be detected by determining whether or not the electrode units, which are arranged along the direction in which the liquid level falls when the amount of liquid in the container decreases, conduct current. Then, the amount of liquid remaining in the container is displayed in steps by using the detection result. Accordingly, not only can the presence/absence of the liquid be simply displayed, but the amount of the remaining liquid can be accurately displayed in steps (for example, the percentage of the remaining liquid to the amount when the container is full) with a simple structure.

DESCRIPTION OF THE PREFERRED EMBODIMENT

Figure 1:
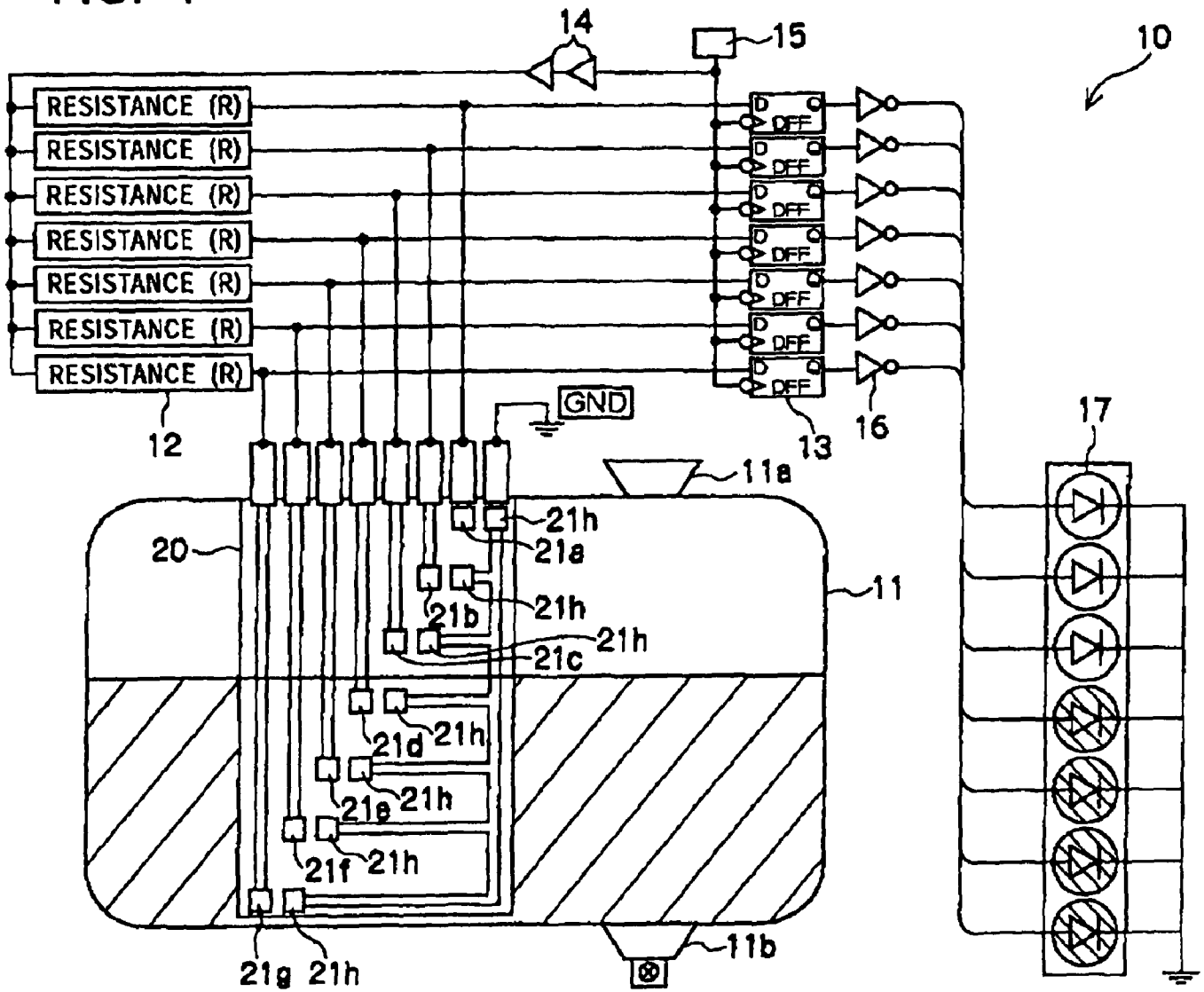
FIG. 1 is a diagram showing a remaining-liquid-amount display apparatus according to an embodiment of the present invention.
Figure 2:
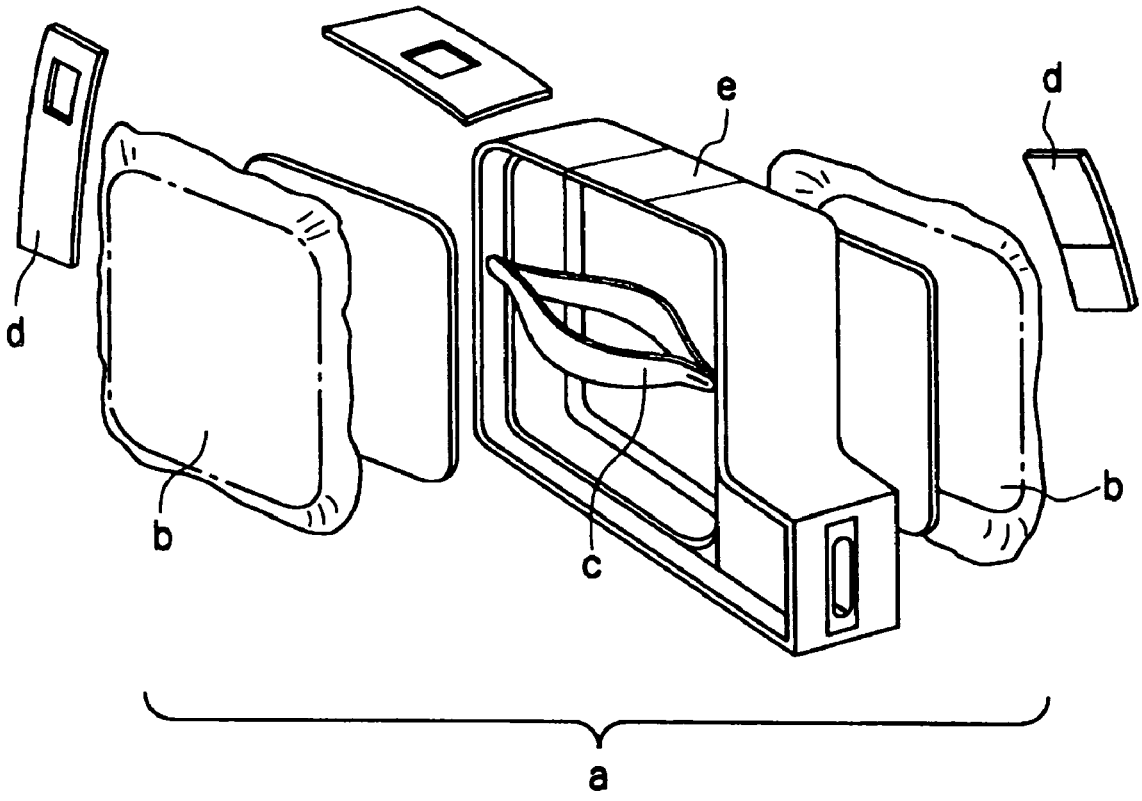
PRIOR ART FIG. 2
FIG. 2 is an exploded perspective view showing a first example of a known ink-remaining-amount detector.
Figure 3:
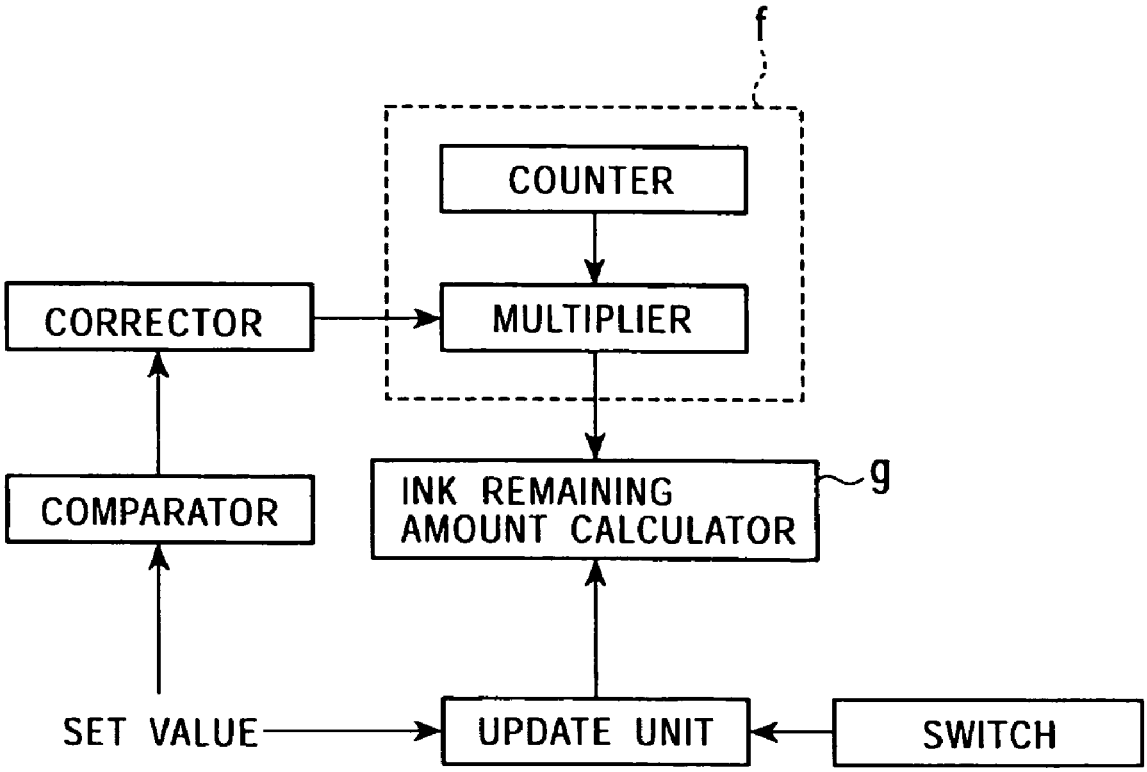
PRIOR ART FIG. 3
FIG. 3 is a block diagram showing a second example of a known ink-remaining-amount detector.
Figure 4:
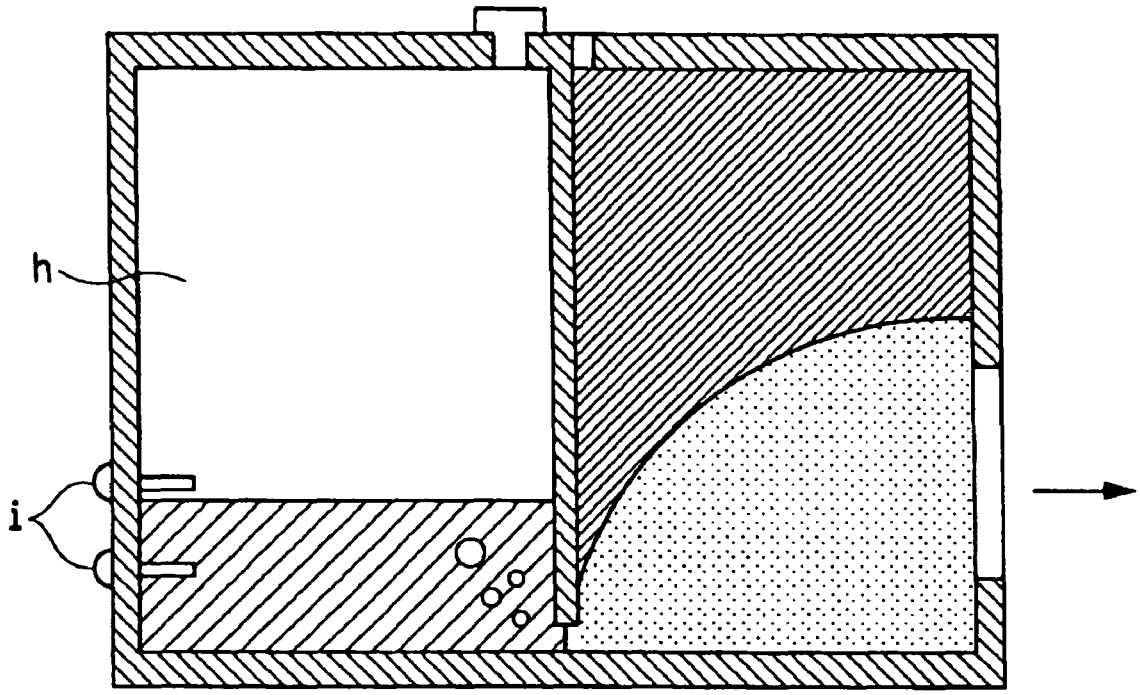
PRIOR ART FIG. 4
FIG. 4 is a sectional side view showing a third example of a known ink-remaining-amount detector.
Figure 5:
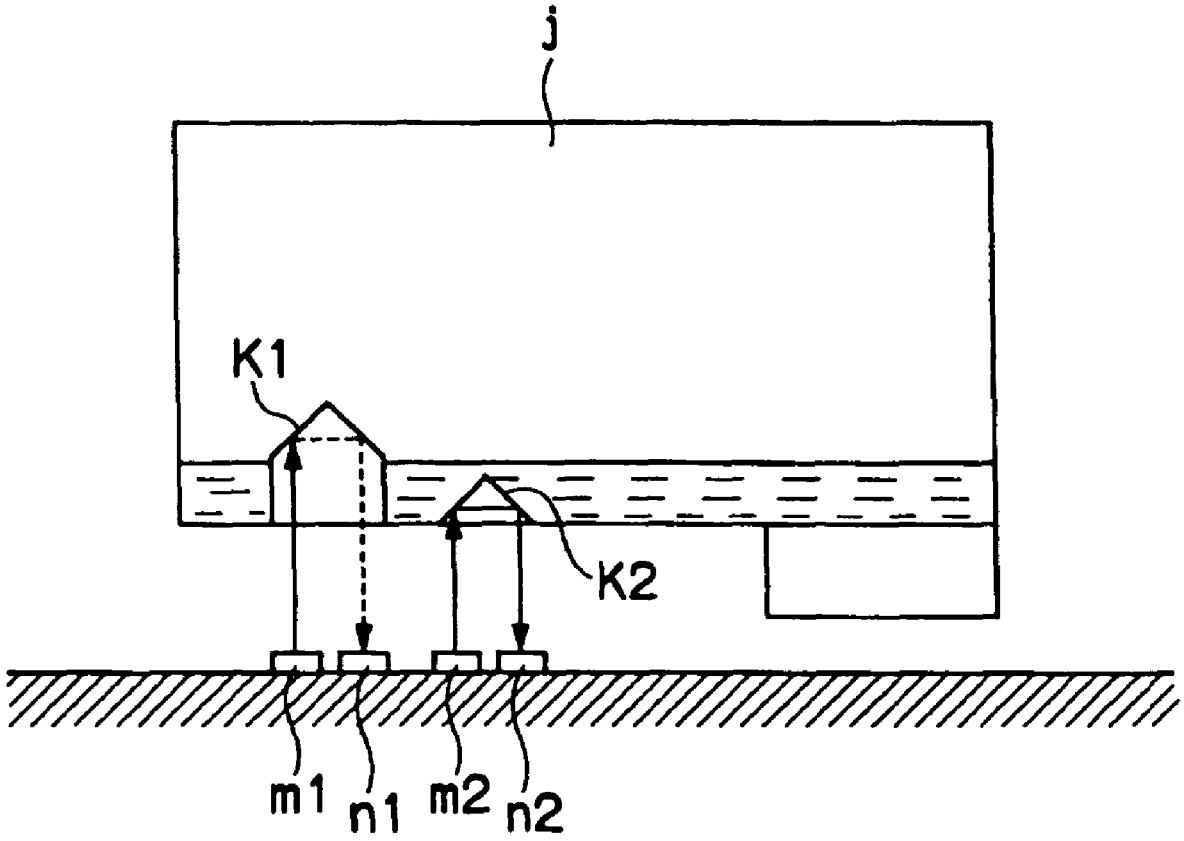
PRIOR ART FIG. 5
FIG. 5 is a sectional side view showing a fourth example of a known ink-remaining-amount detector.

An embodiment of the present invention will be described below with reference to the accompanying drawing. FIG. 1 is a diagram showing a remaining-liquid-amount display apparatus according to an embodiment of the present invention. In the present embodiment, an ink-remaining-amount display apparatus 10 used in an inkjet printer or the like will be described as an example.

With reference to FIG. 1, a container 11 contains ink for an inkjet printer or the like. An ink-injection hole 11*a* is formed in the top surface of the container 11, and an ink outlet 11*b* is formed in the bottom surface of the container 11. The ink outlet 11*b* is connected to an ink flow path of a printer head (not shown).

An ink-remaining-amount detection substrate (hereinafter called simply a substrate) 20 is disposed in the container 11 at the central position of the container 11. As will be described below in detail, the substrate 20 serves to determine the amount of remaining liquid by detecting the liquid level. However, when the container 11 tilts, the liquid level in the container 11 is not parallel to the surface a base supporting the container 11, and if the substrate 20 is disposed at a position close to one of the side surfaces of the container 11, the liquid level rises or falls with respect to the substrate 20 in accordance with the tilt of the container 11 and an accurate liquid level cannot be detected. For this reason, the substrate 20 is disposed at the central position where the influence of the tilt of the container 11 is minimum (that is, where the displacement of the liquid level is minimum), so that the liquid level can be accurately detected even when the container 11 is somewhat tilted.

A plurality of electrode units 21 (21*a* to 21*h*) are provided on the substrate 20. More specifically, seven electrode units 21 are constructed of seven detection electrodes 21*a* to 21*g* and seven common electrodes 21*h*. Each of the common electrodes 21*h* is disposed at a position close to one of the detection electrodes 21*a* to 21*g*.

When the ink contained in the container 11 is consumed and the amount thereof is reduced accordingly, the liquid level moves downward in the figure (that is, in the direction from the ink-injection hole 11*a* to the ink outlet 11*b*). More specifically, the liquid level moves in the direction of gravity when the amount of ink decreases.

The detection electrode 21*a* is disposed at the top position (a position at which the detection electrode 21*a* comes into contact with the ink when the container 11 is full), and the detection electrode 21*g* is disposed at a position close to the bottom surface of the container 11. In addition, the detection electrodes 21*a* to 21*g* are arranged along the direction in which the liquid level falls as the amount of ink decreases, that is, in the direction of gravity, at fixed intervals.

The detection electrodes 21*a* to 21*g* are individually connected to their respective wiring patterns, and the seven common electrodes 21*h* are connected in parallel to a single wiring pattern and are grounded.

The common electrodes 21*h* may be constructed such that the entire region of the common electrodes 21*h* and the wiring pattern come into contact with the ink. However, in the present embodiment, only the rectangular regions of the common electrodes 21*h* come into contact with (are exposed to) the ink, and the wiring pattern is covered such that it does not come into contact with the ink. Thus, the regions of the common electrodes 21*h* which come into contact with the ink are made as small as possible.

The surface area of the detection electrodes 21*a* to 21*g* may be the same as that of the common electrodes 21*h*. Alternatively, the surface area of the common electrodes 21*h* may be greater than that of the detection electrodes 21*a* to 21*g*. When, for example, the ink has a relatively low conductivity, there is a risk that electrical connection between each of the detection electrodes 21*a* to 21*g* and the corresponding common electrode 21*h* cannot be sufficiently ensured. However, such a situation can be avoided by making the surface area of the common electrodes 21*h* greater than that of the detection electrodes 21*a* to 21*g*.

The electrode units 21 are constructed such that they have water repellent surfaces. For example, the electrode units 21 may be composed of a water-repellent material, or a water-repellent coating may be applied to the surface of each electrode unit 21. Accordingly, when, for example, one of the electrode units 21 becomes free from the ink, the ink can be removed from the surface of that electrode unit 21 as quickly as possible, and a false detection, that is, the electrode unit 21 being determined to be in contact with the ink even when it is already free from the ink, can be prevented.

In addition, although not shown in the figure, the surface (outer layer) of each electrode unit 21 is coated with a surface-treated layer having corrosion resistance to the ink and to air. Various kinds of plating materials may be used for forming the surface-treated layer, and gold plating is applied in the present embodiment.

The surface-treated layer is provided in order to prevent temporal degradation of the characteristics of the electrode units 21. More specifically, depending on the kind of metal used for forming the electrode units 21, there is a risk that the metal (electrode units 21) will dissolve in the ink due to physical or electrochemical changes which occur when the electrode units 21 come into contact with the ink contained in the container 11. In addition, when the electrode units 21 come into contact with air, there is a risk that the surfaces of the electrode units 21 will be oxidized and the electrical characteristics thereof will change, for example, the electrical resistance will increase. In such a case, it may not be possible to establish electrical connection between each of the detection electrodes 21*a* to 21*g* and the corresponding common electrode 21*h*. Accordingly, in order to avoid such situations, the surface-treated layer having corrosion resistance to the ink and to air is applied on the surface of each electrode unit 21.

In addition, seven resistances 12 and seven D-type flip flops (DFFs) 13, which correspond to a liquid detector of the present invention, are disposed outside the container 11. Each resistance 12 is electrically connected to a D-input terminal of one of the DFFs 13, and each of the detection electrodes 21*a* to 21*g* is electrically connected to one of electrical lines connecting the resistances 12 to their respective DFFs 13.

Resistances having high resistance values are used as the resistances 12. In the present embodiment, the presence/absence of the ink is detected on the basis of whether or not the detection electrodes 21*a* to 21*g* are in contact with the ink. However, depending on the conductivity of the ink and the surface area of the detection electrodes 21*a* to 21*g*, there is a possibility that only an extremely small amount of current can flow in the ink. Accordingly, resistances having high resistance values are used in order that a sufficient potential difference can be obtained between a case where the detection electrodes 21*a* to 21*g* are in contact with the ink and a case where the detection electrodes 21*a* to 21*g* are not in contact with the ink.

The above-described seven resistances 12 are connected to a pulse generator 15, which corresponds to a voltage source of the present invention, with a delay circuit 14 therebetween. In addition, a clock pulse output from the pulse generator 15 is input to a clock pulse (CK) input terminal of each of the DFFs 13.

Seven LED drivers 16, each of which includes a NOT gate, are provided in accordance with the DFFs 13 at the output side of the DFFs 13, and Q-output terminals of the DFFs 13 are individually connected to their respective LED drivers 16. In addition, seven-light-emitting diodes (LEDs) 17, which correspond to a remaining-liquid-amount display unit of the present invention, are provided in accordance with the LED drivers 16 at the output side of the LED drivers 16, and the LED drivers 16 are individually connected to the anodes of their respective LEDs 17. The LEDs 17 are disposed at a position viewable by the user.

In the ink-remaining-amount display apparatus 10 constructed as above, the pulse generator 15 outputs a clock pulse only when the amount of remaining ink is to be detected. Alternatively, the amount of remaining ink may also be continuously detected by continuously transmitting clock pulses (that is, by continuously applying a current). Since the amount of remaining ink can be detected by a small current, adverse affects do not easily occur even when the current is applied continuously. However, since there is a risk that the ink will be electrolyzed and the characteristics of the ink will change depending on the amount of current applied, the current is applied only for the time necessary for the detection of the amount of remaining ink (for example, several milliseconds).

When a clock pulse is transmitted from the pulse generator 15, a voltage is applied to all of the resistances 12 via the delay circuit 14 at one end thereof. Accordingly, the potential is at a high level, that is, "1 (high)", at one end of all of the resistances 12. When the detection electrodes 21*a* to 21*g* and the common electrodes 21*h* are in contact with the ink, the current flows from the detection electrodes 21*a* to 21*g* to their respective common electrodes 21*h*, and to the ground. Accordingly, the potential at the D-input terminals of the DFFs 13 is set to a low level, that is, "0 (low)", so that the D-input terminals of the DFFs 13 receive "0" as an input value.

On the contrary, when the detection electrodes 21*a* to 21*g* and the common electrodes 21*h* are not in contact with the ink, the current does not flow from the detection electrodes 21*a* to 21*g* to their respective common electrodes 21*h*, and thus the detection electrodes 21*a* to 21*g* function as open ends. Accordingly, the potential at the D-input terminals of the DFFs 13 does not change from the applied potential, that is, the high level "1", and the D-input terminals of the DFFs 13 receive "1" as the input value.

Accordingly, "0" is input to the D-input terminals of the DFFs 13 when the detection electrodes 21*a* to 21*g* and the common electrodes 21*h* are in contact with the ink, and "1" is input to the D-input terminals of the DFFs 13 when the detection electrodes 21*a* to 21*g* and the common electrodes 21*h* are not in contact with the ink.

In addition, when the clock pulse is input to the CK-input terminals of the DFFs 13 while "0" or "1" is being input to the D-input terminals of the DFFs 13, measurement is performed for a time corresponding to the pulse width of the clock pulse, and values input to the D-input terminals at the time corresponding to the falling edge of the clock pulse are output from the Q-output terminals. Once the clock pulse is input to the CK-input terminals, values output from the Q-output terminals are maintained and do not change, even when values input to the D-input terminals change, until the next clock pulse is input to the CK-input terminals.

The time at which the clock pulse is input to the CK-input terminals of the DFFs 13 and the time at which the D-input terminals of the DFFs 13 receive the input values via the resistances 12 are adjusted by the delay circuit 14 such that the falling edge of the clock pulse is input to the CK-input terminals of the DFFs 13 while "0" or "1" is being input to the D-input terminals of the DFFs 13.

The output signals from the Q-output terminals of the DFFs 13 are input to and inverted by their respective LED drivers 16. More specifically, the LED drivers 16 output "0" if "1" is input from the Q-output terminals, and output "1" if "0" is input from the Q-output terminals.

Then, output signals from the LED drivers 16 are input to their respective LEDs 17. The LEDs 17 are turned off when "0" is input and are turned on when "1" is input.

In the state shown in FIG. 1, the detection electrodes 21*a*, 21*b*, and 21*c*, which are the first to third detection electrodes from the top, are not in contact with the ink. Accordingly, "1" is input to the D-input terminals of the corresponding DFFs 13 and output from the Q-output terminals thereof, and is inverted to "0" by the corresponding LED drivers 16. Accordingly, "0" is input to the corresponding LEDs 17, so that the LEDs 17 are turned off.

On the contrary, the detection electrodes 21*d*, 21*e*, 21*f*, and 21*g*, which are the fourth to seventh detection electrodes from the top, are in contact with the ink. Accordingly, "0" is input to the D-input terminals of the corresponding DFFs 13 and output from the Q-output terminals thereof, and is inverted to "1" by the corresponding LED drivers 16. Accordingly, "1" is input to the corresponding LEDs 17, so that the LEDs 17 are turned on. In FIG. 1, the LEDs 17 which are turned on are indicated by hatched lines.

Accordingly, all of the LEDs 17 are turned on if the container 11 is full, and all of the LEDs 17 are turned off if the tank of the container 11 is almost empty. In the present embodiment, the amount of remaining ink can be displayed in eight steps, and the user can determine the amount of remaining ink in eight steps by observing the display apparatus. For example, when four of the seven LEDs 17 are turned on and the remaining three are turned off, as shown in FIG. 1, it means that the amount of remaining ink is slightly more than half-full.

Although an embodiment of the present invention has been described, the present invention is not limited to the above-described embodiment, and the following modifications, for example, are possible:

(1) In the above-described embodiment, the amount of remaining ink is displayed in eight steps by providing seven electrode units 21. In this case, the output signals from the DFFs 13 may also be converted into another type of signals by using a signal converter, and the amount of remaining ink may also be displayed on the-basis of the signals converted by the signal converter.

When, for example, seven output signals are obtained as a detection result, as in the above-described embodiment, the amount of remaining ink can be displayed in eight steps. Accordingly, the amount of remaining ink may also be indicated by, for example, decimal numbers of 0 to 7 by converting the output signals into a three-bit signal (000 to 111). Alternatively, the amount of remaining ink may also be shown on a display or the like by setting a plurality of messages, for example, "remaining amount . . . %", in advance, and selecting one of the messages in accordance with the output signals.

(2) In addition, although seven electrode units 21 are used for detecting the amount of remaining ink in the above-described embodiment, the number of electrode units 21 may also be increased so that the amount of remaining ink can be detected and displayed in a larger number of steps.

(3) In addition, in the above-described embodiment, an ink-remaining-amount display apparatus used in an ink-jet printer has been explained. However, the present invention is not limited to this, and may also be applied to various kinds of remaining-liquid-amount display apparatuses for displaying the amount of various kinds of liquids remaining in a container thereof.

As described above, according to the present invention, an amount of liquid remaining in a container thereof can be accurately displayed with a simple structure.

What is claimed is:

1. A method of manufacturing a remaining-liquid-amount display apparatus for displaying an amount of conductive liquid remaining in a liquid container, comprising:

providing a liquid container having a plurality of electrode units, each unit comprised of at least one detection electrode and at least one common electrode, which are arranged along a direction in which the liquid level falls when the amount of liquid in the container decreases and which conduct current when the electrode units are in contact with the liquid;

providing a voltage and/or current source which periodically applies a voltage and/or current to the electrode units;

providing a plurality of liquid detectors respectively connected to each detection electrode and which detect the presence/absence of the liquid at each of the electrode units; and providing a remaining-liquid-amount display unit which displays the amount of liquid remaining in the container on the basis of the detected result of the presence/absence of the liquid at each of the electrode units; and further wherein information corresponding to whether the liquid is detected at each detection electrode is stored and the remaining-liquid-amount display unit displays the amount of liquid remaining based on the stored information, and further wherein each detection electrode has a corresponding memory element which stores information indicating whether the liquid is detected at detection electrode for the memory element based on the periodically applied voltage and/or current.

2. A method of manufacturing a remaining-liquid-amount display apparatus for displaying an amount of conductive liquid remaining in a liquid container, comprising:

providing a liquid container having a plurality of electrode units which are arranged along a direction in which the liquid level falls when the amount of liquid in the container decreases, each electrode unit including a detection electrode and a common electrode which are disposed in the vicinity of each other and which conduct current when the detection electrode and the common electrode are in contact with the liquid;

providing a voltage and/or current source which periodically applies a voltage and/or current between the detection electrode and the common electrode of each of the electrode units;

providing a plurality of liquid detectors respectively connected to each detection electrode and which detect the presence/absence of the liquid at each of the electrode units; and providing a remaining-liquid-amount display unit which displays the amount of liquid remaining in the container on the basis of the detected result of the presence/absence of the liquid at each of the electrode units; and further wherein information corresponding to whether the liquid is detected at each detection electrode is stored and the remaining-liquid-amount display unit displays the amount of liquid remaining based on the stored information, and further wherein each detection electrode has a corresponding memory element which stores information indicating whether the liquid is detected at detection electrode for the memory element based on the periodically applied voltage and/or current.

3. A method of manufacturing a remaining-liquid-amount display apparatus according to one of claims 1 and 2, further comprising providing a signal converter which converts the detection result of the presence/absence of the liquid at each of the electrode units obtained by the plurality of liquid detectors into a signal of a predetermined type, wherein the remaining-liquid-amount display unit displays the amount of liquid remaining in the container on the basis of the converted signal obtained by the signal converter.

4. A method of manufacturing a remaining-liquid-amount display apparatus according to one of claims 1 and 2, wherein the voltage source is a source which applies the voltage only for a time necessary for the liquid detectors to detect the presence/absence of the liquid.

5. A method of manufacturing a remaining-liquid-amount display apparatus according to one of claims 1 and 2, wherein at least a part of each of the electrode units has a water-repellent surface.

6. A method of manufacturing a remaining-liquid-amount display apparatus according to one of claims 1 and 2, wherein an outer layer of each of the electrode units, is coated with a surface-treated layer having corrosion resistance to the liquid and to air.

7. A method of manufacturing a remaining-liquid-amount display apparatus according to claim 2, wherein the common electrodes are connected in parallel with each other and are exposed only at regions close to the detection electrodes.

8. A method of manufacturing a remaining-liquid-amount display apparatus according to one of claims 1 and 2, wherein the electrode units are disposed at positions where a displacement of the liquid level caused when the container tilts is minimum.

9. A method of manufacturing a remaining-liquid-amount display apparatus for displaying an amount of conductive liquid remaining in a liquid container, comprising:

providing a liquid container having a plurality of electrode units, each unit comprised of at least one detection electrode and at least one common electrode, which are arranged along a direction in which the liquid level falls when the amount of liquid in the container decreases and which conduct current when the electrode units are in contact with the liquid, and wherein the common electrodes of each electrode unit are connected in parallel to an electrical-ground level connection;

providing a voltage and/or current source which applies a voltage and/or current to the electrode units;

providing a liquid detector which detects the presence/absence of the liquid at positions of the electrode units on the basis of whether or not the detection electrode of each electrode unit is at an electrical-ground level; and providing a remaining-liquid-amount display unit which displays the amount of liquid remaining in the container on the basis of the detected result of the presence/absence of the liquid at positions of the electrode units obtained by the liquid detector; and further wherein information corresponding to whether the liquid is detected at each detection electrode is stored and the remaining-liquid-amount display unit displays the amount of liquid remaining based on the stored information, and further wherein each detection electrode has a corresponding memory element which stores information indicating whether the liquid is detected at detection electrode for the memory element based on the periodically applied voltage and/or current.

* * * * *